US009190068B2

(12) United States Patent
Godavarti

(10) Patent No.: US 9,190,068 B2
(45) Date of Patent: Nov. 17, 2015

(54) SIGNAL PRESENCE DETECTION USING BI-DIRECTIONAL COMMUNICATION DATA

(75) Inventor: Mahesh Godavarti, Sunnyvale, CA (US)

(73) Assignee: Ditech Networks, Inc., San Jose, CA (US)

( * ) Notice: Subject to any disclaimer, the term of this patent is extended or adjusted under 35 U.S.C. 154(b) by 2 days.

(21) Appl. No.: 13/079,705

(22) Filed: Apr. 4, 2011

(65) Prior Publication Data

US 2011/0184732 A1 Jul. 28, 2011

Related U.S. Application Data

(63) Continuation of application No. 11/837,229, filed on Aug. 10, 2007, now abandoned.

(51) Int. Cl.
*G10L 21/02* (2013.01)
*G10L 25/78* (2013.01)

(52) U.S. Cl.
CPC ..... *G10L 21/02* (2013.01); *G10L 25/78* (2013.01); *G10L 2025/786* (2013.01)

(58) Field of Classification Search
CPC ..... G10L 25/78; G10L 25/81; G10L 25/84; G10L 2025/786; G10L 21/02
USPC ..... 704/210, 226, 233, 270.1; 381/71.1
See application file for complete search history.

(56) References Cited

U.S. PATENT DOCUMENTS 5,559,881 A * 9/1996 Sih ..... 379/406.08
5,809,463 A * 9/1998 Gupta et al. ..... 704/233
5,835,486 A * 11/1998 Davis et al. ..... 370/287
5,867,574 A * 2/1999 Eryilmaz ..... 379/388.04
5,960,389 A * 9/1999 Jarvinen et al. ..... 704/220
6,061,647 A * 5/2000 Barrett ..... 704/208
6,148,078 A * 11/2000 Romesburg ..... 379/406.07
6,223,154 B1 * 4/2001 Nicholls et al. ..... 704/233
6,631,139 B2 * 10/2003 El-Maleh et al. ..... 370/466
7,027,804 B2 * 4/2006 Mufti et al. ..... 381/91
7,236,929 B2 * 6/2007 Hodges ..... 704/233
7,263,074 B2 * 8/2007 LeBlanc ..... 370/286
7,505,594 B2 * 3/2009 Mauro ..... 704/208
8,374,851 B2 * 2/2013 Unno et al. ..... 704/208
2002/0161576 A1 * 10/2002 Benyassine et al. ..... 704/229
2003/0053618 A1 * 3/2003 Marchok et al. ..... 379/406.01
2004/0076271 A1 * 4/2004 Koistinen et al. ..... 379/88.11
2004/0181398 A1 * 9/2004 Sung et al. ..... 704/219
2004/0240664 A1 * 12/2004 Freed ..... 379/406.01
2005/0063533 A1 * 3/2005 Dettmer ..... 379/388.02

(Continued)

*Primary Examiner* — James Wozniak
(74) *Attorney, Agent, or Firm* — Mark H. Whittenberger, Esq.; Holland & Knight LLP

(57) ABSTRACT

A system and method for using bi-directional conversation data to improve signal presence detection are disclosed. The detector module is adapted to communicate with a signal enhancement module. The detector module collects data from a transmit direction of the connection and a receive direction of a data connection. The collected data from the transmit and the receive direction is used to classify at least one of data in the transmit direction and data in the receive direction. Responsive to the classification, the signal enhancement module enhances data in one of the transmit direction and the receive direction. Hence, data classification accuracy is improved by using data from both the transmit and receive directions. In one embodiment, the detector module applies a voice activity detection module (VAD) process to detect the presence or absence of voice data in the collected data.

24 Claims, 9 Drawing Sheets

(56) References Cited

U.S. PATENT DOCUMENTS

| | | | | |
|---|---|---|---|---|
| 2005/0192798 | A1* | 9/2005 | Vainio et al. | 704/223 |
| 2006/0015333 | A1* | 1/2006 | Gao | 704/233 |
| 2006/0195316 | A1* | 8/2006 | Sakuraba | 704/208 |
| 2007/0150264 | A1* | 6/2007 | Tackin et al. | 704/207 |
| 2007/0174052 | A1* | 7/2007 | Manjunath et al. | 704/219 |
| 2007/0271093 | A1* | 11/2007 | Wang et al. | 704/210 |
| 2008/0232353 | A1* | 9/2008 | Vafin et al. | 370/352 |
| 2011/0150210 | A1* | 6/2011 | Allen et al. | 379/406.08 |

* cited by examiner

SIGNAL PRESENCE DETECTION USING BI-DIRECTIONAL COMMUNICATION DATA

CROSS-REFERENCE TO RELATED APPLICATIONS

This application is a continuation of U.S. patent application Ser. No. 11/837,229, filed on Aug. 10, 2007, entitled "Signal Presence Detection Using Bi-Directional Communication Data" which is incorporated herein by reference in its entirety.

BACKGROUND

1. Field of Art

The present invention generally relates to the field of signal detection and more specifically to using data from both directions of a bi-directional communication channel to enhance signal quality.

2. Description of the Related Art

Recent technological advancements have increased the use of speech communication applications, such as speech recognition, hands-free telephony and speech coding. These advancements have lead to increased use of voice activity detection (VAD) algorithms and processes. VAD processes detect the presence or absence of human speech from audio samples.

In particular, in hands-free telephone applications, VAD is used to control and reduce average bit rate and to enhance overall coding quality. Further, VAD processes are used to implement discontinuous transmission (DTX) in portable devices, which enhances system capacity and/or signal quality by reducing co-channel interference and power consumption. However, conventional VAD techniques separately process transmitted data and received data. Commonly, two independent VAD processes are used, one for the transmitted data and one for the received data.

However, because system parameters are constantly varying, conventional VAD techniques can erroneously classify speech and noise, and vice versa. In particular, in mobile environments, background noise is diverse and highly variable, and can lead to low signal-to-noise ratios (SNRs). In low SNR environments, existing VAD methods cannot distinguish between speech and noise when parts of the speech are below the noise threshold.

SUMMARY

The present invention overcomes the deficiencies and limitations of the prior art by providing a system and method for using bi-directional data to detect the presence or absence of a signal. In an embodiment, an apparatus comprises a signal detection module for collecting data from a transmit direction and a receive direction of a connection. The collected data from the transmit direction and the receive direction is used to classify at least one of data in the transmit direction and data in the receive direction. For example, the signal detection module classifies data in the transmit direction as speech, noise, music, pause or other suitable categories. In one embodiment, the signal detection module applies a voice activity detection module (VAD) process to detect the presence or absence of voice data in the collected data. A signal detection module is adapted to communicate with the signal enhancement module and enhances data responsive to the classification by the signal detection module. In an embodiment, the signal enhancement module comprises a discontinuous transmission (DTX) module for modifying apparatus power consumption responsive to the classification by the signal detection module. Alternatively, the signal enhancement module comprises a noise cancellation module for removing background or ambient noise from data in the transmit direction or receive direction responsive to the classification by the signal detection module.

In an embodiment, a data connection including a transmit direction and a receive direction is established. Classification data, such as pitch, stationarity, amplitude, tonal quality or other characteristics, is collected from both the transmit direction and the receive direction and used to process data from the transmit direction and data from the receive direction. Responsive to the processed transmit direction data and the processed receive direction data, data in at least one of the transmit direction and the receive direction is modified. By processing both transmit direction data and receive direction data, information about both transmit and receive directions is evaluated to determine which direction includes the desired signal data.

The features and advantages described in the specification are not all inclusive, and in particular, many additional features and advantages will be apparent to one of ordinary skill in the art in view of the drawings, specification and claims. Moreover, it should be noted that the language used in the specification has been principally selected for readability and instructional purposes, and may not have been selected to delineate or circumscribe the inventive subject matter.

BRIEF DESCRIPTION OF DRAWINGS

The disclosed embodiments have other advantages and features which will be more readily apparent from the following detailed description and the appended claims, when taken in conjunction with the accompanying drawings, in which:

DETAILED DESCRIPTION

Figure 1:
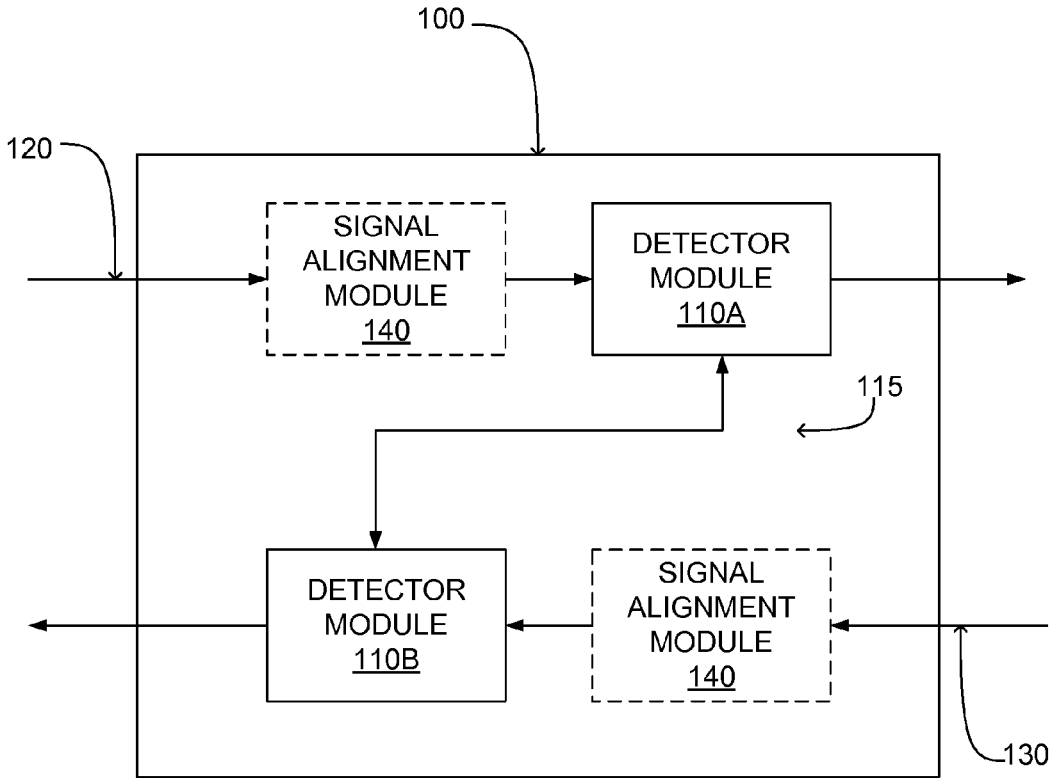
FIG. 1 is a block diagram of a signal detection system which uses bi-directional communication data to enhance a voice conversation according to one embodiment of the invention.

A system and method for using bi-directional conversation data to detect the presence or absence of a signal are described. For purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the invention. This is done merely for convenience and to give a general sense of the invention. This description should be read to include one or at least one and the singular also includes the plural unless it is obvious that it is meant otherwise.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will be apparent from the description below. In addition, the present invention is not described with reference to any particular programming language. It will be appreciated that a variety of programming languages may be used to implement the teachings of the invention as described herein. As described herein, for purposes of illustration, references are made to the classification of signals as noise or speech; however, this classification is merely an example and the invention described herein can be used to detect, classify and/or enhance any type of signal having one or more possible classifications.

System Architecture

FIG. 1 is a block diagram of a signal detection system 100 which uses bi-directional conversation data to detect a signal according to one embodiment of the invention. The signal detection system 100 comprises a transmitter detector module 110A and a receiver detector module 110B and also optionally includes a signal alignment module 140. The signal detection system 100 also includes a transmit communication path 120 and a receive communication path 130, which transmit data signals from the device including the signal detection system 100 and receive data signals for the device including the signal detection system 100 respectively. In one embodiment the signal detection system 100 comprises a digital signal processor (DSP) or other processor capable of receiving input signals and generating output signals. Alternatively, the signal detection system 100 comprises one or more software and/or firmware processes for execution by a general purpose microprocessor or controller, a field programmable gate array (FPGA), an application specific integrated circuit (ASIC) or a combination thereof.

In an embodiment, the transmitter detector module 110A and the receiver detector module 110B, further described below, comprise multiple software processes for execution by a processor (not shown) and/or firmware applications. The software and/or firmware processes and/or applications can be configured to operate on a general purpose microprocessor or controller, a field programmable gate array (FPGA), an application specific integrated circuit (ASIC) or a combination thereof. In another embodiment, the modules comprise portions or sub-routines of a software or firmware application which performs multiple conversation enhancement operations. Moreover, other embodiments can include different and/or additional features and/or components than the ones described here.

The transmitter detector module 110A is coupled to the receiver detector module 110B via a data link 115. Data link 115 communicates data between or among the transmitter detector module 110A and the receiver detector module 110B. In one embodiment, the data link 115 comprises a bus. The data link 115 may represent one or more buses including an industry standard architecture (ISA) bus, a peripheral component interconnect (PCI) bus, a universal serial bus (USB), inter-integrated circuit (I2C) bus, serial peripheral interface (SPI) bus, a proprietary bus configuration or other suitable bus providing similar functionality. Alternatively, the data link 115 comprises any communication channel capable of transmitting data to and receiving data from the transmitter detector module 110A and the receiver detector module 110B. Hence, the transmitter detector module 110A receives data from the data link 115 and a transmit communication path 120 and uses data from both sources to detect signals received via the transmit communication path 120. Similarly, the receiver detector module 110B receives data from the data link 115 and a receive communication path 130 and uses data from both sources to detect signals received via the receive communication path 130. In an alternative embodiment, a single module includes the transmitter detector module 110A and the receiver detector module 110B, so the single module receives data from both the transmit communication path 120 and the receive communication path 130 and uses the received data to detect signals from at least one of the communication paths 120, 130.

In one embodiment, the transmitter detector module 110A and the receiver detector module 110B are used with algorithms applied to transmitted or received data, respectively, for improving signal quality (e.g., increasing signal to noise ratio or data transmission rate) or reducing power consumption by a device including the signal detection system. In an embodiment, the transmitter detector module 110A and the receiver detector module 110B use a voice activity detection (VAD) process to detect signal presence for determining how to improve signal quality. For example, a detector module 110A, 110B is used in conjunction with adaptive noise correction (ANC), discontinuous transmission (DTX), silence suppression, acoustic echo control (AEC), automatic level control (ALC) or any other signal improvement algorithm or process responsive to the VAD process results. In another embodiment, a detector module 110A, 110B uses the VAD algorithm to classify data into categories such as speech, pause, voice, non-voice, speech, music or any other suitable categories. In one embodiment, a detector module 110A, 110B is used with multiple signal improvement algorithms and/or classifications selected by a user during operation. Alternatively, the detector module 110A, 110B is used in one or more predefined signal improvement algorithms and/or classifications.

The transmit communication path 120 is used to transmit data from a device including the signal detection system 100. In one embodiment, the transmitter detector module 110A is inserted into the transmit communication path 120 so that data being transmitted to a device is routed through the transmit detector module 110A. The transmit communication path 120 comprises a communication channel capable of transmitting data. In one embodiment, the transmit communication path 120 uses packet switching, circuit switching message switching, or any other suitable technique, to transmit data between devices.

The receive communication path 130 is used to receive data for the device including the signal detection system 100. In one embodiment, the receiver detector module 110B is inserted into the receive communication path 130 so that data being received from another device data is routed through the receive detector module 110B. The receive communication path 110B comprises a communication channel capable of receiving data. In one embodiment, the receive communication path 130 uses packet switching, circuit switching message switching, or any other suitable technique, to receive data.

Figure 8:
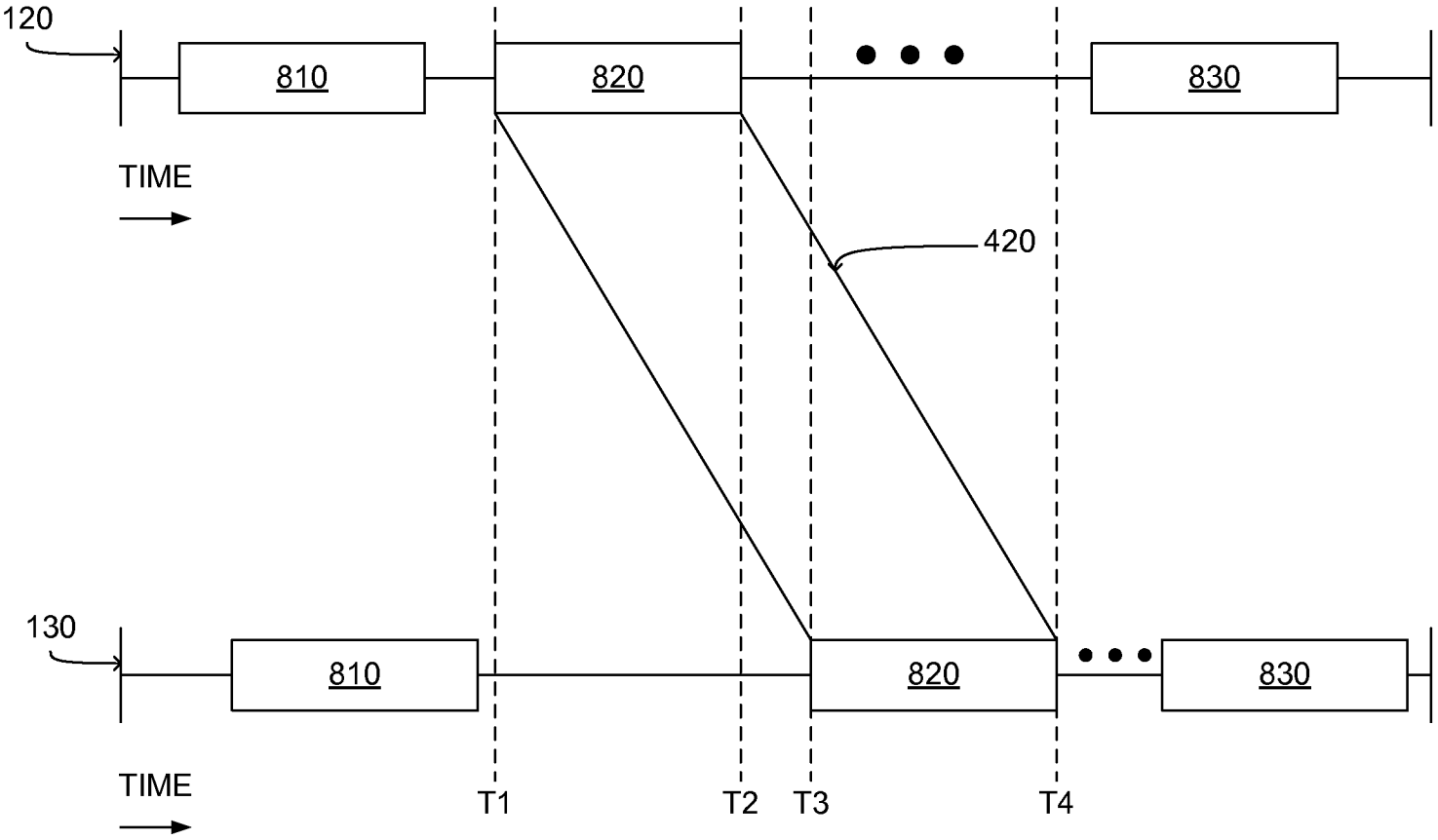
FIG. 8 is an example application of call synchronization according to one embodiment of the invention.

In one embodiment, the signal detection system 100 also includes an optional signal alignment module 140 which correlates data from the transmit communication path 120 and the receive communication path 130 with a connection. When the signal detection module 100 is used in a packet-switched communication system, such as voice over Internet Protocol (VoIP), where data is not transmitted and received sequentially, the signal alignment module 140 identifies a bi-directional communication channel including the transmitted and received data. For example, the signal alignment module 140 associates the transmitted and received data with a voice conversation between two or more parties. In one embodiment, the signal alignment module 140 identifies time-stamps or individual segments of the transmitted data and time-stamps or individual segments of the received data and matches the identified data. Alternatively, the signal alignment module 140 examines an identifier in the transmitted data, such as a header field in the data packets, and stores the transmitted data until data associated with the same identifier is received, allowing both transmitted and received data from the same connection to be evaluated. FIG. 8, further described below, shows an example of signal alignment, where packets including data from a voice conversation are stored, or buffered, until a packet including data from the same voice conversation is received in a different time interval. In an embodiment where a circuit-switched network, such as a time-division multiplexing (TDM) network or other network where data is sequentially transmitted and received, the signal alignment module 140 is optional.

Figure 2:
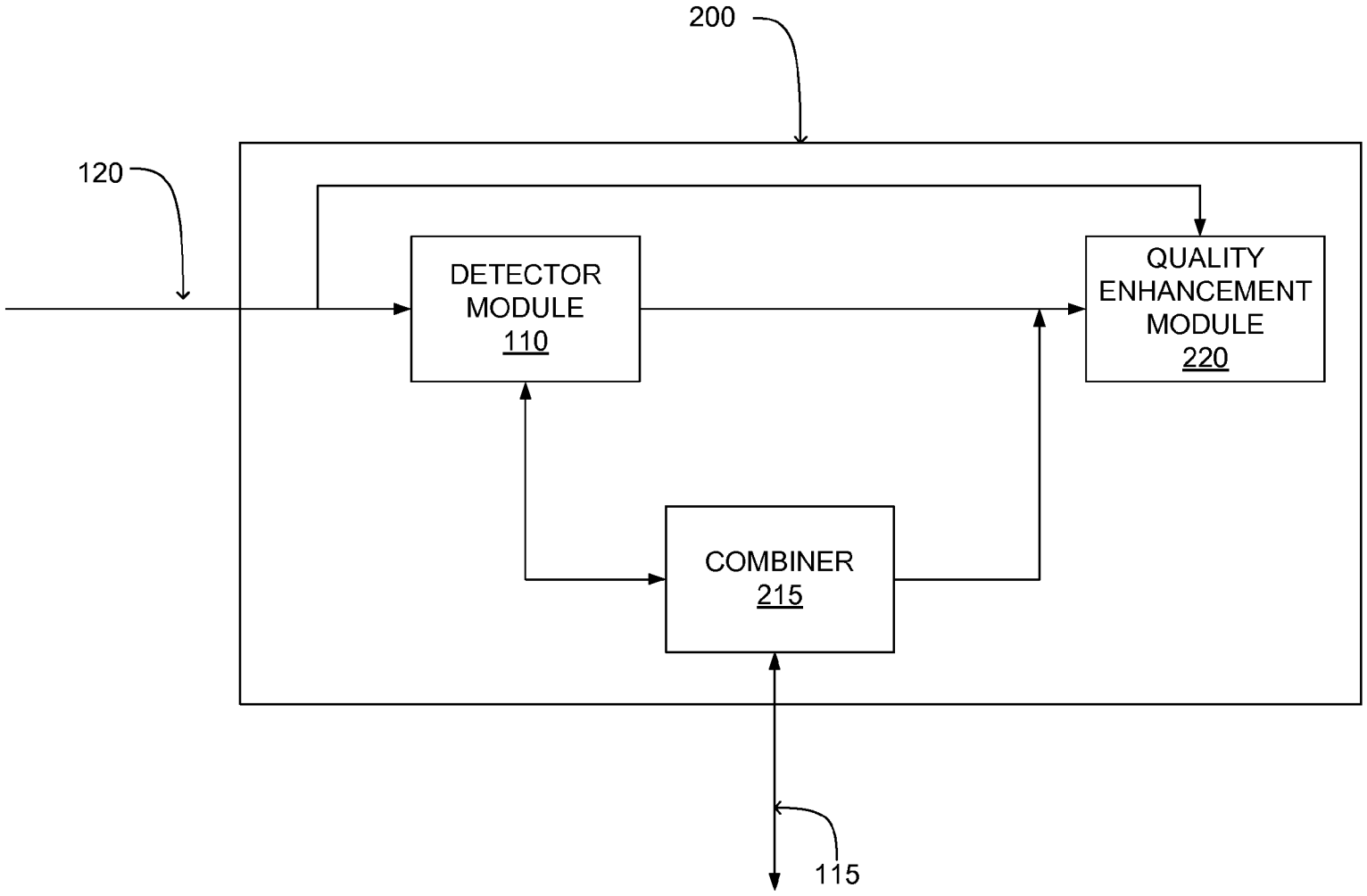
FIG. 2 is a block diagram of a signal improvement module which uses bi-directional communication data for adaptive noise correction according to one embodiment of the invention.

FIG. 2 is a block diagram of a signal enhancement module 200 which uses bi-directional communication data to detect signal presence, according to one embodiment of the invention. In one embodiment, the signal enhancement module 200 is used to improve signal quality, such as by implementing adaptive noise correction (ANC). The signal enhancement module 200 comprises a signal detector module 110, a quality enhancement module 220, a combiner 215, a transmit communication path 120 and a data link 115.

The detector module 110 classifies transmitted or received data. For example, the detector module 110 implements a voice-activity detection (VAD) algorithm to categorize data into speech, pause, voice, non-voice, music or any other categories capable of discerning characteristics of the data transmitted from or received by a device including the signal enhancement module 200. For example, the detector module 110 determines whether voice data is present on the transmit communication path 120 by classifying transmitted data as either speech or pause. The detector module 110 also receives, through data link 115 and the combiner 215, data from the receive communication path 130. Hence, data link 115 enables detector module 110 to use data from the receive communication path 130 when classifying signals using the transmit communication path 120. Hence, the detector module 110 uses data from both directions of a bi-directional communication channel to classify data in one direction.

In one embodiment, a detector module 110 is associated with each of the transmit communication path 120 and the receive communication path 130 and uses the data link 115 to share classification results between data between and among the detector modules 110. By sharing data, each detector module 110 accesses the classification results from other detector modules 110 and uses data from the other signal detection modules 110 in the classification process. For example, a detector module 110 associated with the transmit communication path 120 ascertains the data classification results from a detector module 110 associated with the receive communication path 130 and uses the received data classification when classifying data transmitted along the transmit communication path 120.

The combiner 215 is coupled to the module 110 and communicates data from the data path 115 to the detector module 110. In one embodiment, the combiner 215 receives and stores classification results from a detector module 110 which classifies data from the receive communication path 130 and transmits the classification results to the detector module 110 associated with the transmit communication path 120 for use in classifying data from the transmit communication path 120. Alternatively, the combiner 215 receives classification results from the detector module 110 and the data path 115 and uses the combination of classification results to generate a combined classification. In yet another embodiment, the combiner 215 is optional and the detector module 110 directly receives classification results or data through the data path 115 and uses the received data when classifying data received via transmit signal path 120.

The quality enhancement module 220 applies a noise reduction algorithm, such as an adaptive noise correction algorithm, or other suitable noise-reduction method, to the data being transmitted using the transmit communication path 120. In an embodiment, the quality enhancement module 220 removes noise components from voice conversation data without affecting the volume, or other characteristics, of the voice or speech data. For example, the quality enhancement module 220 removes background noise, such as road noise, background conversations or jet noise while preserving voice or speech data. In one embodiment, a quality enhancement module 220 is associated with each of the transmit communication path 120 and the receive communication path 130, allowing noise reduction algorithms to be separately applied to data communicated using each path 120, 130. The quality enhancement module 220 uses data from a detector module 110 associated with the transmit communication path 120 and from a detector module 110 associated with the receive communication link 130 to modify the quality of signals transmitted through the transmit communication path 120. For example, if data from the transmit communication path 120 is classified as speech and data from the receive communication path 130 is classified as pause, speech quality is improved by modifying a noise threshold to increase the amount of data that is classified as noise and filtered. Alternatively, the quality enhancement module 220 increases the amplitude of the data transmitted through the transmit communication path 120 In another embodiment, classifying data transmitted via the transmit communication path 120 as speech and classifying data received via the receive communication path 130 as noise causes a quality enhancement module 220 associated with the transmit communication path 120 to increase the amplitude of transmitted data and a quality enhancement module 220 associated with the receive communication path 130 to reduce the amplitude of received data. In a conventional voice conversation, voice and/or data is commonly present on one of the transmit communication path 120 or the receive communication path 130 link at a time, with noise or pause data present on the other path 120, 130. Hence, classifying data from one of the paths 120, 130 as pause or noise indicates that the data on the other path 130, 120 is not noise, but speech, voice or another desired data type. The above description of a voice conversation is merely an example, and the detector module can be used to classify any situation where signal data is only presents in one direction of a communication channel at a time.

Figure 3:
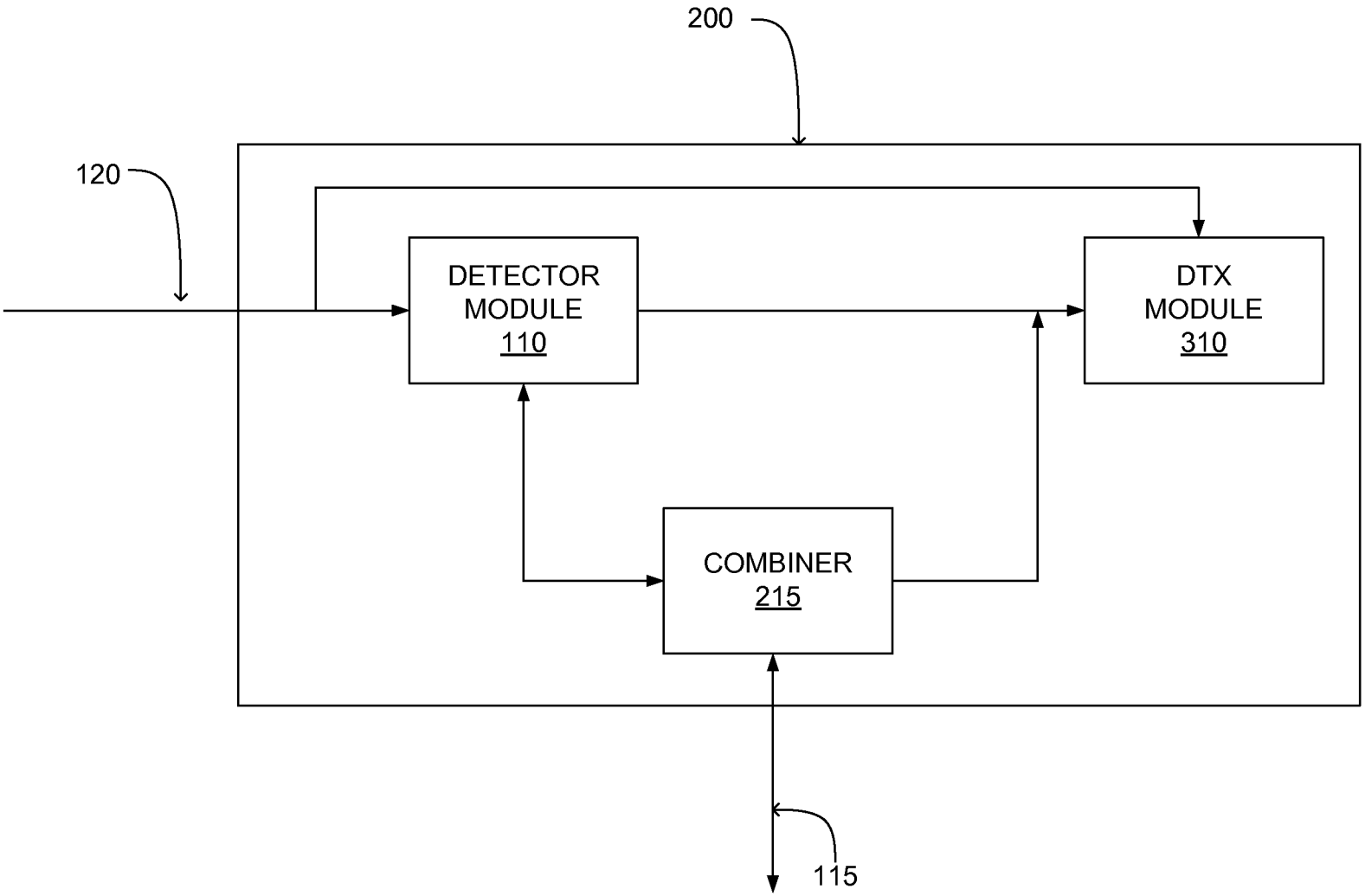
FIG. 3 is a block diagram of a signal improvement module which uses bi-directional communication data for discontinuous transmission according to one embodiment of the invention.

FIG. 3 is a block diagram of a signal improvement module 200 which uses bi-directional communication data to implement discontinuous transmission (DTX) according to one embodiment of the invention. The signal improvement module 200 comprises a detector module 110, a DTX module 310, a combiner 215, a transmit communication path 120 and a data link 115.

The DTX module 310 powers-down, or mutes, the signal improvement module 200 and/or a communication device including the signal improvement module 200 when the transmit communication path 120 does not include voice, speech or other desired data. This minimizes power consumption when voice or other desired data is not transmitted which increases the operational time of the device including the signal improvement module 200. Powering-down the communication device including the signal improvement module 200 also decreases network interference from the communication device including the signal improvement module 200, improving received signal quality for other communications devices in the network. The DTX module 310 uses data form the detector module(s) 110 associated with the transmit communication path 120 and the receive communication path 130 to determine when to conserve power.

As described above in conjunction with FIG. 2, the detector module 110 uses data from both the transmit communication path 120 and the receive communication path 130 to classify data included on the transmit communication path 120. Because the classification uses data from the transmit communication path 120 and the receive communication path 130, the DTX module 310 input more accurately determines the presence or absence of speech in the transmitted data, improving the DTX module 310 performance. As speech data in a conversation is typically present only in either the transmit direction or the receive direction at a given time, data from the receive communication path 120 (e.g., pause, noise or speech classification) aids in determining whether transmitted data is noise or speech. For example, if it is not clear if data from the transmit communication path 120 contains speech but data from the receive communication path 130 is classified as speech, the DTX module 310 receives input from the detector module 110 that the transmit communication path 120 does not include voice data, causing the DTX module 310 to conserve the power of the communication device (e.g., a transmitter or other device capable of transmitting or receiving a signal) including the signal detection system 100 or signal improvement module 200 Additionally, using bi-directional communication data for signal classification allows the DTX module 310 to generate comfort noise for transmission using a communication path that more accurately represents actual background noise when a transmitter is powered-down. Hence, communicating data between detector modules 110 using the data link 115 and/or the combiner 215 improves power saving and decreases interference by using both transmitted and received data classification to resolve situations where it is unclear whether the transmit communication link 120 includes noise or speech data, enabling the DTX module 310 to more accurately determine the presence or absence of speech, or other desired data, improving power conservation and reducing signal interference.

Although described in FIG. 2 and FIG. 3 above as discrete modules, in various embodiments, any or all of the detector module 110, the quality enhancement module 220, the DTX module 310 and/or the combiner 215 can be combined. This allows a single module to perform the functions of one or more of the above-described modules.

System Operation

Figure 4:
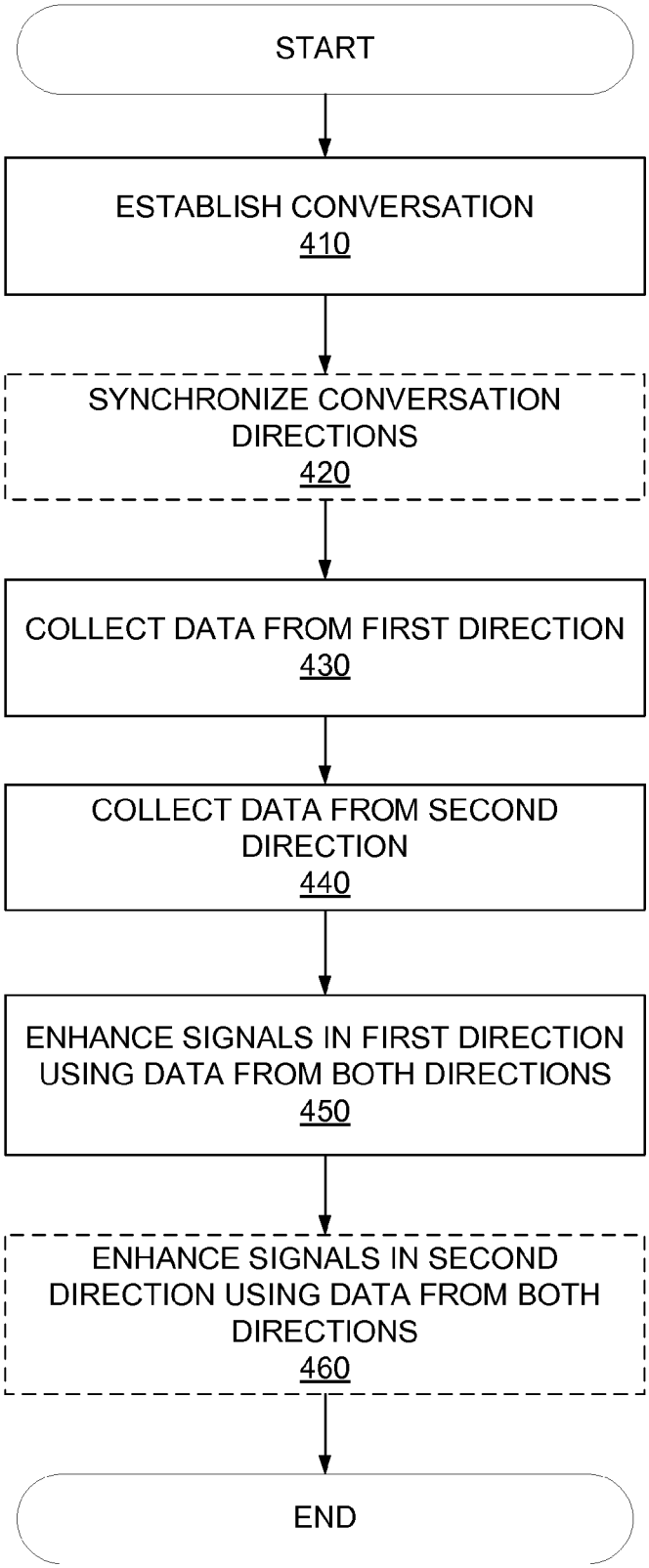
FIG. 4 is a flow chart of a method for using bi-directional communication data to enhance signal quality according to one embodiment of the invention.

FIG. 4 is a flow chart of a method for using bi-directional communication data to detect signal presence over a data connection according to one embodiment of the invention.

Initially, a connection is established 410 between two or more parties and used to transmit data between or among the parties. In one embodiment, a packet-switched network such as voice-over Internet Protocol (VoIP) is used to transmit data using the connection. Alternatively, a circuit switched network is used to continuously transmit and receive data comprising the conversation.

If a packet-switched network is used, data transmitted using the connection is synchronized 420, so that transmitted and received data is associated with the same connection. As data is not contiguously received in a packet switched network, but received at varying intervals in different packets, synchronization allows examination of transmitted and received data from the same connection. In one embodiment, transmitted data is stored, or buffered, until data associated with the same connection is received. Alternatively, transmitted data is queued for a predetermined interval prior to await receipt of data from the same connection prior to transmission.

Data from a first direction (e.g., the transmit direction) is then collected 430 and data from a second direction (e.g., the receive direction) is also collected 440. The collected data is used by a detector module 110 to classify transmitted and/or received data. Examples of the collected data include pitch, stationarity, amplitude, tonal quality, linear predictive coding (LPC) coefficients, signal harmonic structure, fixed codebook indices, signal level variation or other data capable of classifying the data. For example, collected pitch data is used to classify data speech while collected stationarity data is used to classify data as noise. Alternatively, data collection is used to classify data as music, speech or as any category capable of identifying a type of transmitted or received data. However, the above description of data collection and the types of data collected are merely examples and the collection comprises extracting any information capable of identifying connection data.

In one embodiment, signals in the transmit call direction are enhanced 450 responsive to the collected data. For example, data collected from the transmit and receive directions is used to modify a threshold value determining whether data is processed as speech or noise, to modify signal amplitude, to modify error correction methods or to perform other enhancement operations. Using data collected from both directions accounts for the characteristic that desired data is typically present in one of the transmit or receive directions during different time intervals. For example, during a typical voice conversation, one party is speaking during each time interval, so one direction includes data, such as speech, while the other direction includes noise or pause data. Hence, data indicating one direction includes noise or pause data increases the likelihood that the other direction includes speech data and is processed accordingly. In another embodiment, the collected data is also used to enhance 460 data signals in the second direction, so that data from the first direction is incorporated into enhancement of data from the second direction.

Figure 5:
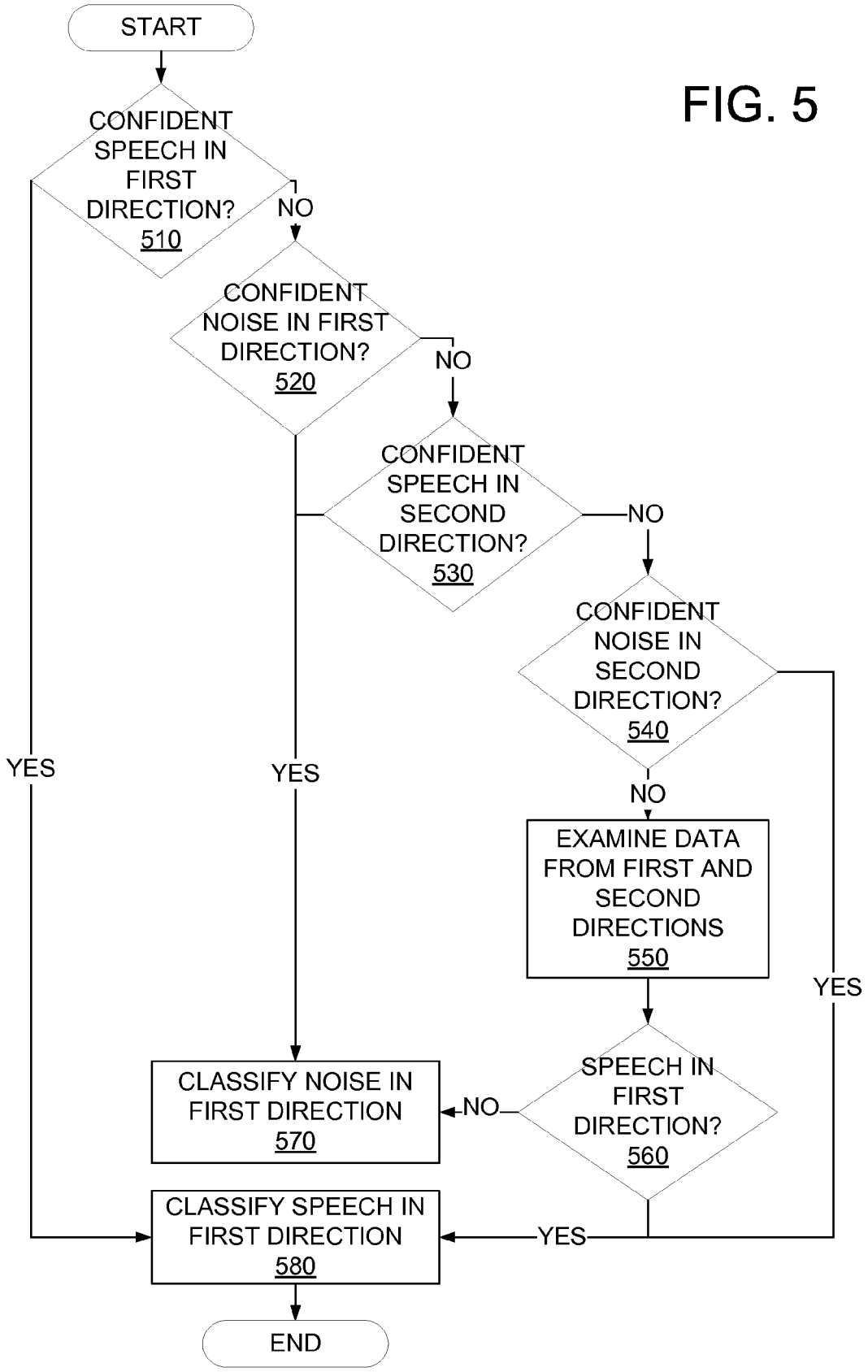
FIG. 5 is a block diagram of a method for performing voice activity detection (VAD) using bi-directional communication data according to one embodiment of the invention.

FIG. 5 is a flow chart of a method for using bi-directional communication data to classify signals in one direction of a connection according to one embodiment of the invention. For purposes of illustration, FIG. 5 describes using bi-directional communication data to classify data as speech or noise; however, this classification is merely an example and the bi-directional communication data can be used to categorize data in any situation where signal data is only present in one direction at a time.

Initially, data from a first direction is compared to a speech threshold to determine 510 a speech confidence level indicating whether or not the received data is speech. If the speech confidence level indicates that the received data is speech, the data is classified 580 as speech. If the speech confidence level does not indicate that the received data is speech, the received data is compared to a noise threshold to determine 520 a noise confidence level indicating whether or not the data is noise. If the noise confidence level indicates that the received data is noise, the data is classified 570 as noise.

However, if neither the speech threshold nor the noise threshold for the first direction indicates the data is speech or noise, respectively, a second direction is examined. Data from the second direction is compared to a speech threshold to determine 530 a speech confidence level indicating whether or not the data from the second direction is speech. In most conversations, when speech is present in one direction, there is likely no speech in the other direction, corresponding to one party listening to the other party. Hence, if speech is detected in one direction, data from the other direction can typically be classified as ambient noise. Thus, if the speech confidence level indicates that data from the second direction is speech, data from the first direction is classified 570 as noise.

If the speech confidence level does not indicate that data from the second direction is speech, the data from the second direction is compared to a noise threshold to determine 540 a noise confidence level indicating whether or not data from the second direction is noise. If the noise confidence level indicates that data from the second direction is noise, data from the first direction is classified 580 as speech. Because most conversations involve one party speaking and another party listening, detecting noise in the second direction indicates that data in the first direction is likely speech (e.g., one party speaking and the other party listening).

However, if neither the speech threshold nor the noise threshold for the second direction indicates the data is speech or noise, respectively, additional data from both the first direction and second direction is examined 550. In an embodiment, this additional data comprises pitch data, stationarity data, amplitude data, tone data or other data capable of differentiating noise and speech. Examining data from both the first and second directions enables the ambiguity in data classification to be resolved while accounting for characteristics from both directions. Hence, the bi-directional additional data is used to classify 570 the data as noise or to classify 580 the data as speech with greater accuracy. Table 1 below describes example results of the above-described classification method and shows how classification data from both a transmit and receive direction are used to classify data from the transmit direction.

TABLE 1

Example bi-directional classification results for data in a transmit direction.

| Uni-Directional Transmit Direction Classification | Uni-Directional Receive Direction Classification | Bi-Directional Transmit Classification | Bi-Directional Receive Classification |
|---|---|---|---|
| Voice (high confidence) | Noise (high confidence) | Voice | Noise |
| Voice (low confidence) | Voice (high confidence) | Noise | Voice |
| Voice (high confidence) | Voice (high confidence) | Voice | Voice |
| Noise (high confidence) | Noise (low confidence) | Noise | Voice |

Evaluating data from both the first direction and the second direction increases the amount of data used to classify received data to improve the accuracy of the classification. In particular, bi-directional data allows for more accurate classification when both the transmit and receive directions include voice, or other signal data, or when both the transmit and receive directions do not include voice data. Further, using bi-directional data allows the classification to take advantage of the property that most conversations do not simultaneously transmit and receive data but alternate between transmitting and receiving data. This allows the presence or absence of signal data in one direction to indicate the absence or presence of signal data in the other conversation direction.

Figure 6:
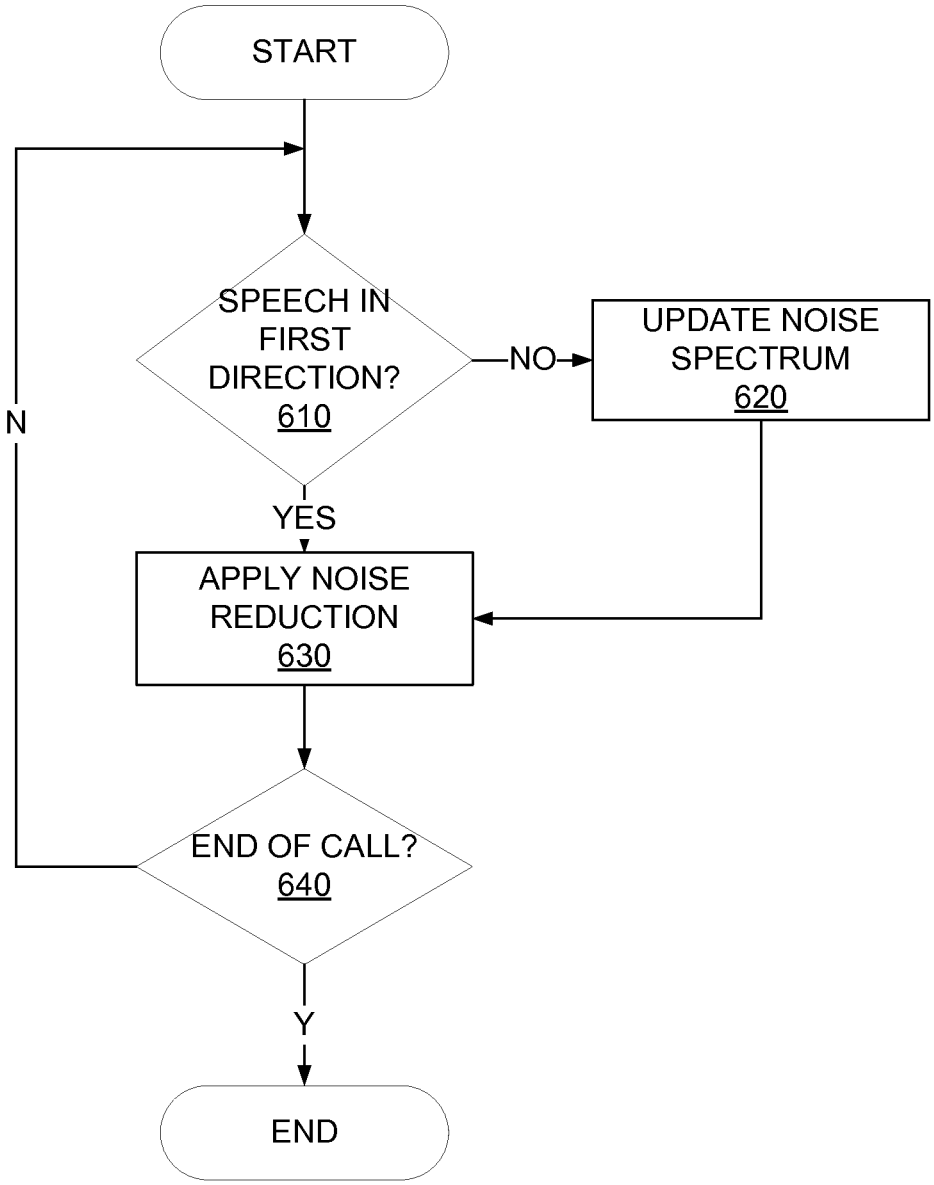
FIG. 6 is a flow chart of a method for using voice activity detection to implement adaptive noise correction according to one embodiment of the invention.

FIG. 6 is an example flow chart of a method for using voice activity detection to implement adaptive noise correction (ANC) according to one embodiment of the invention. The method illustrated in FIG. 6 implements a bi-directional classification method as described above in conjunction with FIG. 5, or another suitable bi-directional classification method.

Initially, data received in a first direction is examined to determine 610 whether the data is speech. This determination uses data from the first and a second direction of the conversation to classify the data, such as by using the method described above in conjunction with FIG. 5. For example, transmitted and received data is examined to determine whether speech is transmitted and noise or pause is received. Responsive to determining that data in the first direction is speech, a noise reduction algorithm is applied 630 to improve speech quality. Responsive to determining that the received data is not speech, a noise spectrum is updated 620 and then the noise reduction algorithm is applied 630 to enhance signal quality. This updated noise spectrum allows for more precise classification of data as noise or speech. For example, when data from both directions is used to classify the received data, updating 620 the noise spectrum increases the classification accuracy of subsequently received data by accounting for properties of both directions. However, the above-described classification of data as noise or speech is merely an example, and the received data can be classified into any suitable categories.

After applying 630 the noise reduction method, data is examined to determine 640 whether additional data is being transmitted. If data is still being transmitted, it is again determined 610 whether data in the first direction is speech, and the above-described method is repeated for the new data.

Figure 7:
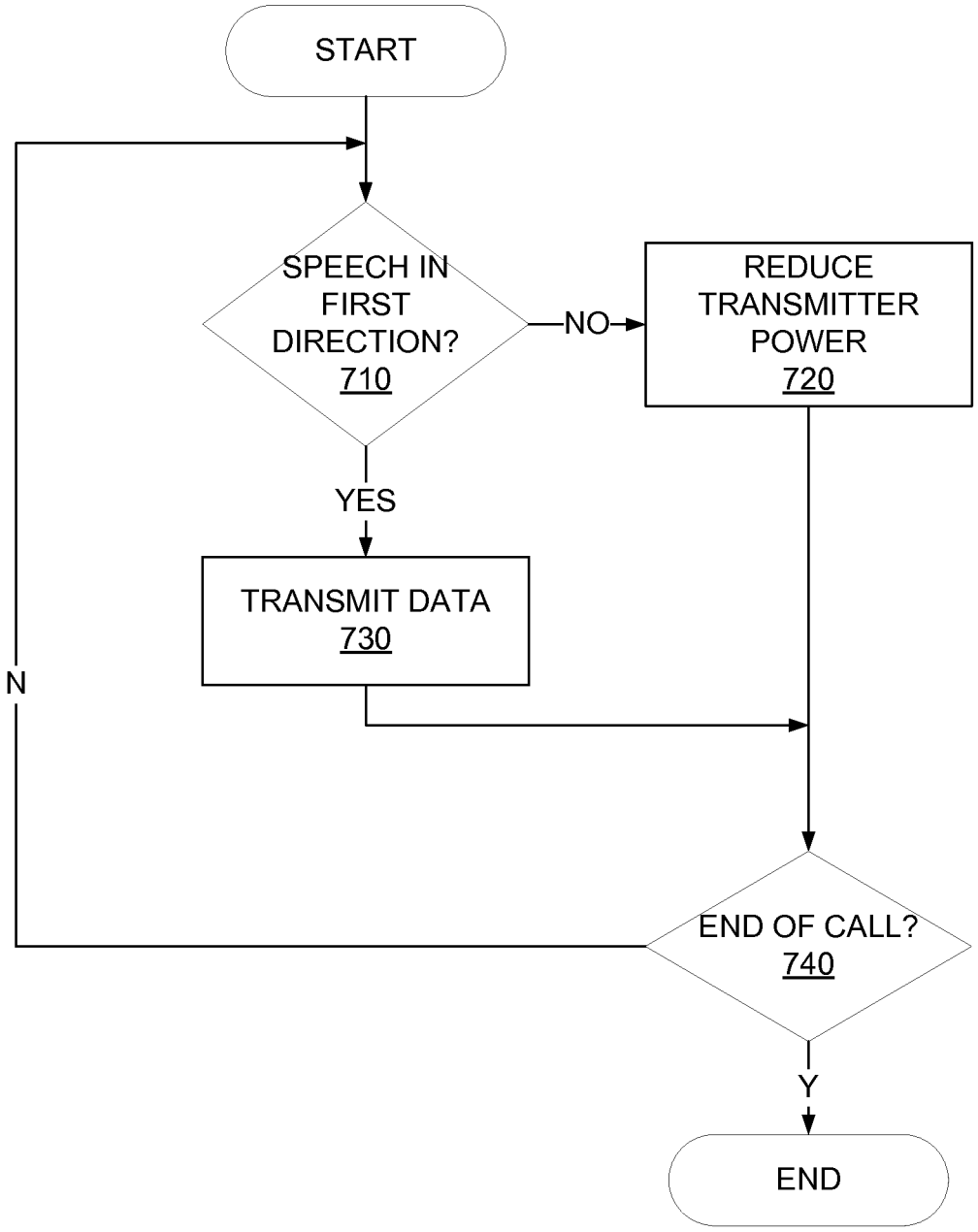
FIG. 7 is a flow chart of a method for using voice activity detection to implement discontinuous transmission according to one embodiment of the invention.

FIG. 7 is an example flow chart of a method for using voice activity detection to implement discontinuous transmission (DTX) according to one embodiment of the invention. The method illustrated in FIG. 7 implements a bi-directional classification method as described above in conjunction with FIG. 5, or another suitable bi-directional classification method.

Initially, data received in the transmit direction is examined to determine 710 whether the data is speech. This determination uses data from the transmit and receive directions to classify the data, such as by using the method described above in conjunction with FIG. 5. Responsive to determining that the data in the transmit direction is speech, the data is transmitted 730 to another device, and the transmitter continues to receive power. Responsive to determining that the data is not speech, transmitter power is reduced 720. In the reduced-power state, a DTX stream is transmitted to indicate to other devices that the connection is still active, but that the local transmitter is powered-down. When it is unclear whether the transmitted data is speech or noise, received data is also examined to determine how to classify the transmitted data. In an embodiment, the DTX stream comprises comfort noise approximating characteristics of transmitter background noise. A signal classification process that uses bi-directional communication data allows the comfort noise stream to more closely approximate background noise to ensure the connection between devices is not terminated.

After transmitting 730 the data or reducing 720 the transmitter power, the data in the transmit direction is examined to determine 740 whether data is still being transmitted. If data is still being transmitted, it is again determined 710 whether the data in the transmit direction is speech, and the above-described method is repeated for the newly transmitted data.

Example Operation

FIG. 8 is an example application of call synchronization 420 according to one embodiment of the invention.

In one embodiment, a packet switched network, such as a voice over Internet Protocol (VoIP) network, is used to transmit and receive data associated with a connection. Packet-switching divides a connection among multiple packets, each including partial information from the connection. Because data comprising a connection is not continuously transmitted, connection data can be separated by packets including data form different connection or can arrive at varying time intervals. Synchronization allows data from a both directions of a connection to be examined, even when the connection data arrives during different time intervals.

In the example shown in FIG. 8, temporal data flow through the transmit communication path 120 and the receive communication path 130 is shown. Conversation packets 820 include data associated with the desired connection and additional packets 810 and 830 include data associated with one or more different connections. As shown in FIG. 8, because the connection data is divided among multiple packets transmitted and received at different times, the connection packets 820 are not temporally aligned. In the example of FIG. 8, a connection packet 820 is transmitted from time T1 to time T2. However, no data from the same connection is received until time T3. Hence, the temporal gap from time T2 to time T3 prevents use of received data to classify or analyze the transmitted data. Because of this temporal gap, synchronization is used so that both transmitted and received data is available at the same time to classify or modify data.

In one embodiment, data from the transmit communication path 120 is stored for a predetermined length of time or until a packet associated with the same connection is received. Hence, in the example of FIG. 8, packet 820 from the transmit communication path 120 is stored until a packet 820 from the same connection is received from the receive communication path 130. This allows use of received data for the enhancement, modification and/or classification of transmitted data even when data from different directions of the connection arrive at different times.

Figure 9:
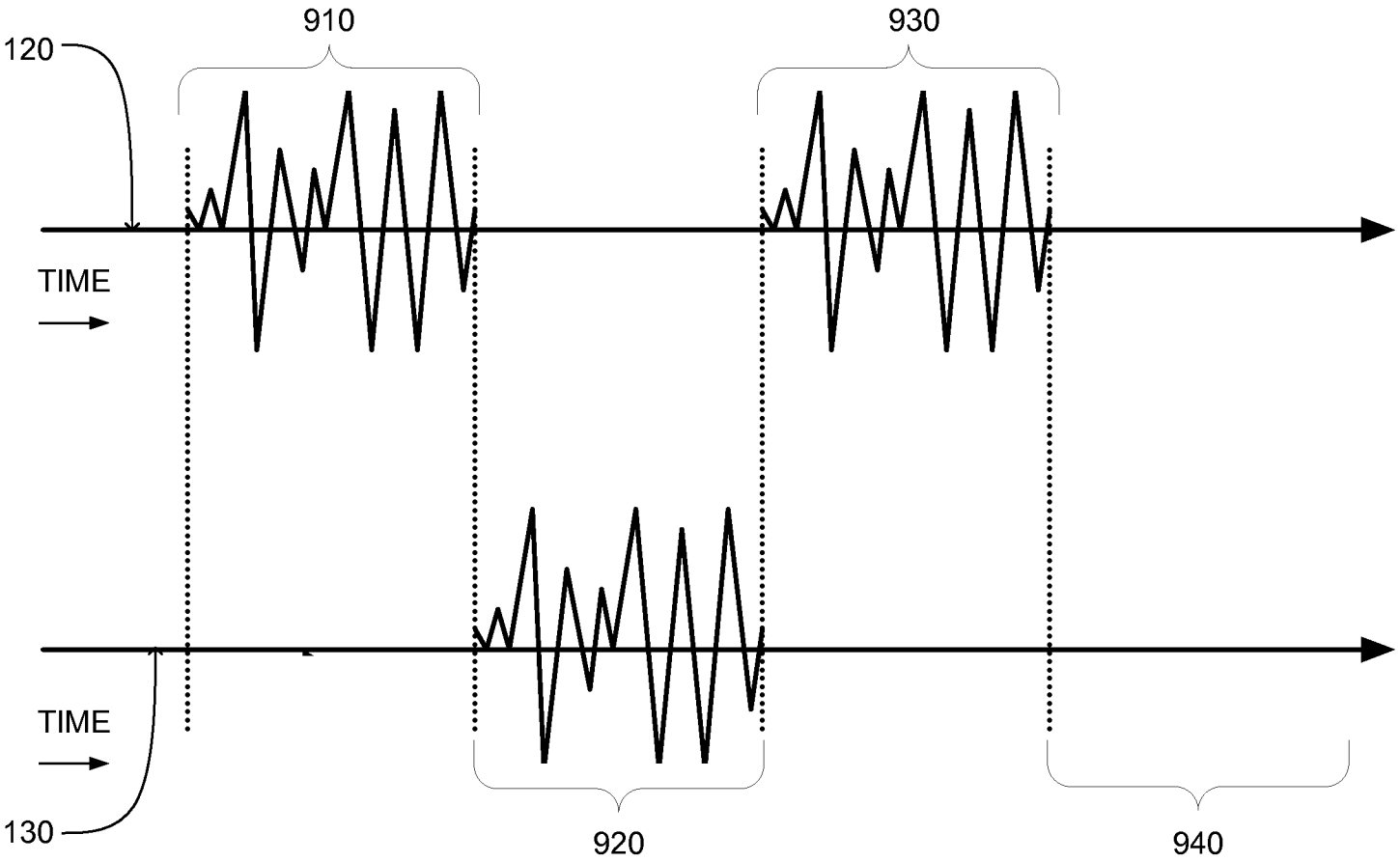
FIG. 9 is an example voice conversation for processing using one embodiment of the invention.

FIG. 9 is an example of a voice conversation for processing by one embodiment of the invention.

During conventional voice conversations, one of the transmit communication path 120 and the receive communication path 130 includes signal data while the other path 130, 120 includes noise or pause data. For example, during intervals 910 and 930, the transmit communication path 120 carries signal data (e.g., voice, speech, music or other suitable data types) while the receive communication path 130 includes noise or pause data. This indicates that during different time intervals, signal data is not simultaneously transmitted and received. For example, this indicates that one party is speaking by transmitting signal data while another party is listening, so no speech data is received. Hence, during intervals 910 and 930, determining that noise or pause data is present along the receive communication path 130 indicates that the data along transmit communication path 120 is signal data rather than noise. Hence, when it is unclear whether transmit communication path 120 includes signal or noise data, the presence or absence of signal data within the receive communication path 130 is used in classifying the transmitted data.

Similarly, during interval 920, the receive communication path 130 includes signal data, while the transmit communication path 120 includes noise or pause data. Hence, interval 920 illustrates data flow when data is received rather than transmitted. When the received data cannot conclusively be classified as signal or noise, the transmitted data is also examined. Depending on whether signal or noise data is transmitted, the received data is classified as noise or signal respectively. Interval 940 represents a situation where data is not transmitted or received, so both the transmit communication path 120 and the receive communication path 130 include noise or pause data. As no signal data is transmitted or received during interval 940, examination of both communication paths 120, 130 does not modify data classification in either direction.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three, for example, some embodiments may include non-transitory computer memory. Of course, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

What is claimed is:

1. An apparatus for detecting signal presence using bidirectional communication data comprising:

a memory;

at least one processor associated with the memory;

a signal detection module, using the at least one processor, for collecting data from a transmit direction, collecting data from a receiving direction and classifying collected data from a first direction as signal or noise based in part on collected data from a second direction, the second direction different than the first direction and wherein the first direction and the second direction are each one of the transmit direction and the receiving direction, wherein the signal detection module applies voice activity detection (VAD) to analyze the collected data and to determine whether the collected data is speech, pause, voice, non-voice, or music, wherein the data received from the transmit direction and the data received from the receive direction is used to modify a threshold value determining whether data is processed as speech or noise, wherein if neither a speech threshold nor a noise threshold from the second direction indicates the data is speech or noise, the signal detection module examines additional data from both the first direction and the second direction; and a signal enhancement module, using the at least one processor, for enhancing data responsive to the classification of the collected data in the first direction, wherein the classification of the collected data in the first direction is used to enhance a data signal in the second direction.

2. The apparatus of claim 1, further comprising:

a signal alignment module adapted to communicate with the signal detection module for synchronizing data from the transmit direction and the receiving direction of a conversation.

3. The apparatus of claim 2, wherein synchronizing data includes queuing transmitted data for a predetermined interval prior to collecting data from the receiving direction.

4. The apparatus of claim 2, wherein synchronizing data includes examining the transmitted and received data from the same connection in a packet-switched network.

5. The apparatus of claim 1, wherein the signal detection module applies the voice activity detection (VAD) to classify at least one of the collected data from the transmit direction and the collected data from the receiving direction.

6. The apparatus of claim 1, wherein the collected data from the transmit direction is used as the basis for classifying the collected data as signal or noise, the collected data including pitch data, stationarity data, amplitude data, signal harmonic structure, signal level variations, linear predictive coding (LPC) coefficients and tonal quality data.

7. The apparatus of claim 1, wherein the collected data from the receiving direction is used as the basis for classifying the collected data as signal or noise, the collected data including pitch data, stationarity data, amplitude data, signal harmonic structure, signal level variations, linear predictive coding (LPC) coefficients and tonal quality data.

8. The apparatus of claim 1, wherein the signal enhancement module also modifies a power consumption of the apparatus responsive to the classification.

9. The apparatus of claim 1, wherein the apparatus further comprises:

a discontinuous transmission (DTX) module, adapted to communicate with the signal enhancement module, for powering-down the apparatus responsive to the classification indicating no data is transmitted.

10. The apparatus of claim 1, wherein:

the signal enhancement module enhances data by applying a noise reduction process to the data.

11. A method for enhancing signal quality using bi-directional communication data comprising:

establishing a data connection including a transmit direction and a receive direction;

collecting classification data from the transmit direction;

collecting classification data from the receive direction;

classifying data from a first direction as signal or noise based in part on collected data from a second direction, the second direction being different than the first direction and wherein the first direction and the second direction are each one of the transmit direction and the receiving direction, wherein classifying includes applying voice activity detection (VAD) to analyze the collected data and to determine whether the collected data is speech, pause, voice, non-voice, or music, wherein the data received from the transmit direction and the data received from the receive direction is used to modify a threshold value determining whether data is processed as speech or noise, wherein if neither a speech threshold nor a noise threshold from the second direction indicates the data is speech or noise, the signal detection module examines additional data from both the first direction and the second direction; and modifying power consumption of a transmitting device responsive to the classification of the transmit direction data and the classification of the receive direction data, wherein the classification of the collected data in the first direction is used to enhance a data signal in the second direction.

12. The method of claim 11, further comprising:

modifying data from at least one of the transmit direction and the receive direction responsive to the classification of the transmit direction data and the classification of the received direction data, wherein the modifying comprises applying a noise reduction process to data from the transmit direction.

13. The method of claim 11, wherein the classification of the data in the transmit direction is based at least in part on a classification of data in the receive direction as signal data or noise data.

14. The method of claim 11, wherein the classification of the data in the receive direction is based at least in part on a classification of data in the transmit direction as signal data or noise data.

15. The method of claim 13, wherein classifying data in the transmit direction as signal or noise comprises:

applying a voice activity detection (VAD) algorithm to the data in the transmit direction; and responsive to a result of the VAD algorithm, processing the data in the transmit direction.

16. The method of claim 14, wherein classifying data in the receive direction as signal or noise comprises:

applying a voice activity detection (VAD) algorithm to the data in the receive direction; and responsive to a result of the VAD algorithm, processing the data in the transmit direction.

17. The method of claim 11, wherein modifying power consumption of the transmitting device comprises:

increasing power consumption of the transmitting device responsive to classifying the transmit direction data as signal and classifying the receive direction data as noise.

18. The method of claim 11, wherein modifying power consumption of the transmitting device comprises:

decreasing power consumption of the transmitting device responsive to classifying the transmit direction data as noise and classifying the receive direction data as signal.

19. The method of claim 11, wherein the collected data from the transmit direction is used as the basis for classifying the collected data as signal or noise, the collected data including pitch data, stationarity data, amplitude data, signal harmonic structure, signal level variations, linear predictive coding (LPC) coefficients and tonal quality data.

20. The method of claim 11, wherein the collected data from the receiving direction is used as the basis for classifying the collected data as signal or noise, the collected data including pitch data, stationarity data, amplitude data, signal harmonic structure, signal level variations, linear predictive coding (LPC) coefficients and tonal quality data.

21. A non-transitory computer readable storage medium having instructions thereon that when executed by one or more processors causes the processors to:

establish a data connection including a transmit direction and a receive direction;

collect classification data from the transmit direction;

collect classification data from the receive direction;

classify data from a first direction as signal or noise based in part on collected data from a second direction, the second direction being different than the first direction and wherein the first direction and the second direction are each one of the transmit direction and the receiving direction, wherein classifying includes applying voice activity detection (VAD) to analyze the collected data and to determine whether the collected data is speech, pause, voice, non-voice, or music, wherein the data received from the transmit direction and the data received from the receive direction is used to modify a threshold value determining whether data is processed as speech or noise, wherein if neither a speech threshold nor a noise threshold from the second direction indicates the data is speech or noise, the signal detection module examines additional data from both the first direction and the second direction; and modify power consumption of a transmitting device responsive to the classification of the transmit direction data and the classification of the receive direction data, wherein the classification of the collected data in the first direction is used to enhance a data signal in the second direction.

22. The computer readable storage medium of claim 21, wherein the instructions to cause the processors to classify data in the transmit direction as signal or noise further comprises instructions that cause the processors to:

apply the voice activity detection (VAD) algorithm to the data in the transmit direction; and process the data in the transmit direction in response to a result of the VAD algorithm.

23. The non-transitory computer readable medium of claim 21, wherein the collected data from the transmit direction is used as the basis for classifying the collected data as signal or noise, the collected data including pitch data, stationarity data, amplitude data, signal harmonic structure, signal level variations, linear predictive coding (LPC) coefficients and tonal quality data.

24. The non-transitory computer readable medium of claim 21, wherein the collected data from the receiving direction is used as the basis for classifying the collected data as signal or noise, the collected data including pitch data, stationarity data, amplitude data, signal harmonic structure, signal level variations, linear predictive coding (LPC) coefficients and tonal quality data.

* * * * *